United States Patent [19]

Koike et al.

[11] 4,292,821

[45] Oct. 6, 1981

[54] NEEDLE SELECTION MECHANISM IN A HAND-OPERATED KNITTING MACHINE

[75] Inventors: Mitsuhito Koike; Yasuhiro Iwasaki, both of Kodaira, Japan

[73] Assignee: Silver Seiko, Ltd., Kodaira, Japan

[21] Appl. No.: 98,335

[22] Filed: Nov. 27, 1979

[30] Foreign Application Priority Data

Dec. 4, 1978 [JP] Japan ..... 53/149002

[51] Int. Cl.[3] ..... D04B 7/00; D04B 15/66

[52] U.S. Cl. ..... 66/75.2

[58] Field of Search ..... 66/75.1, 60 R, 604

[56] References Cited

U.S. PATENT DOCUMENTS

| | | | |
|---|---|---|---|
| 2,821,073 | 1/1958 | Mehnert | 66/75.1 XR |
| 3,611,753 | 10/1971 | Krause | 66/75.1 |
| 4,015,446 | 4/1977 | Kagaya | 66/75.2 |
| 4,137,729 | 2/1979 | Engler et al. | 66/75.1 |

FOREIGN PATENT DOCUMENTS

| | | | |
|---|---|---|---|
| 48-28383 | 8/1973 | Japan | 66/75.1 |
| 135706 | 4/1977 | Mexico | 66/75.1 |

*Primary Examiner*—Ronald Feldbaum

*Attorney, Agent, or Firm*—Lane, Aitken, Kice & Kananen

[57] ABSTRACT

A needle selection mechanism in a hand-operated knitting machine in which collisions of parts are minimized to reduce production of noises is disclosed. The mechanism comprises a patterning data carrier mounted alongside a needle bed and a pair of needle selector units mounted on a carriage and each including first and second drums each having a set of tiltable data storing elements mounted thereon. A set of patterning data are applied from the data carrier to each selector unit to be stored thereon when the unit passes the carrier which is fed from row to row when the carriage passes it. During a movement of the carriage on the needle bed, a preceding one of the selector units effects selective actuations of movable knitting needles in accordance with the data stored thereon. The tilted data storing elements on both drums of a following one of the selector units are restored to their initial positions by a clearing member common to both drums which operates in time before the following unit reaches the data carrier.

6 Claims, 7 Drawing Figures

NEEDLE SELECTION MECHANISM IN A HAND-OPERATED KNITTING MACHINE

BACKGROUND OF THE INVENTION

This invention relates to a hand-operated home knitting machine, and more particularly to a needle selection mechanism in a hand-operated knitting machine in which needle selection is controlled in accordance with a patterning or needle selection program prepared therefor.

Hand-operated knitting machines on which a knitted fabric having a desired design pattern thereon can be produced are normally provided with needle selection functions which are controlled in accordance with a patterning or needle selection program prepared therefor. Conventionally, a perforated or punched program card or sheet carries a needle selection program in the form of punched holes formed in rows and columns therein. A program reading device which is mounted alongside the needle bed of the knitting machine and has a set of feeler elements reads a row of punched holes of the program card or sheet, and during a sliding movement of the carriage on the needle bed a needle selector member on the carriage selects knitting needles in the needle bed in accordance with the readings of the program by the program reading device. Since such readings of the needle selection program are mechanically transmitted to the needle selector member and the needle selector member mechanically engages with the butts of knitting needles for their selection, considerable noises are produced by the associated parts of the machine. Taking it into consideration that hand-operated home knitting machines are typically used indoors by housewives or young women, it is always required for a hand-operated knitting machine to have, at least, minimized production of noises caused thereby.

SUMMARY OF THE INVENTION

It is, therefore, an object of the present invention to provide a needle selection mechanism in a hand-operated knitting machine by which selection of knitting needles is effected reliably with a minimized production of noises in accordance with a needle selection program provided by a perforated program card or sheet.

According to the present invention, there is provided a needle selection mechanism in a hand-operated knitting machine of the type having a needle bed with a plurality of knitting needles mounted therein and a carriage mounted for longitudinal slidable movement on the needle bed, wherein it comprises a program carrier mounted alongside the needle bed and carrying a patterning program in the form of punched holes arranged in rows and columns thereon, the mechanism further comprising a first drum means having thereon a plurality of settable elements adapted to be set from their initial positions in accordance with a row of the punched holes when the carriage passes the program carrier in a direction, the first drum means being mounted for rotation about an upright shaft fixed on the carriage and having thereon an integral gear adapted to be engaged, at one diametrical position thereof, with a rack provided along the needle bed, the gear being engaged, at the other diametrical position thereof, with a second gear which is integrally attached to a second drum means, the second drum means being rotatable about an inclined shaft fixed on the carriage and having thereon a plurality of settable elements mounted for engagement with the corresponding settable elements on the first drum means to be set thereby from their initial positions in accordance with the settings of the first drum means, the second drum means being operable to select the knitting needles in accordance with the settings of the settable elements thereon during movement of the carriage in the other direction on the needle bed, all the settable elements on the first and second drum means being restored to their initial positions by a clearing means mounted on the carriage after completion of selection of the knitting needles in accordance with the settings on the second drum means.

During a directional movement of the carriage on the needle bed, the first-mentioned gear is rotated in a direction by the rack on the needle bed in a manner in which it rolls on the rack so that the second gear is rotated in the other direction by the first gear as if it rolls on an imaginary line which is in parallel with the rack and tangential to the second gear at a diametrically opposite position thereof to the first gear. Thus, transmission of data for needle selection from the program carrier to the first drum means and then from the first to the second drum means is accomplished during similar rolling engagement between them, thereby minimizing collisions of parts which cause production of noises. Needle selection is effected also with minimized collisions of parts such that, during rotation of the second drum means, those settable elements thereon which are, for example, in their initial positions are successively brought into engagement at their lower sections, with butts of knitting needles aligned very near to the above-mentioned imaginary line to gradually displace or push same forwardly to select them. Thus, production of noises associated with needle selection is minimized in the needle selection mechanism according to the present invention.

Preferably, the clearing means includes a common clearing member mounted for pivotal motion from an initial inoperative position to an operative position in which it is engaged with the settable elements of the first and second drum means in their set positions to restore same to their initial positions. The clearing member may be connected to a cam follower lever so that a pivotal motion in a particular direction brings the clearing member into its operative position. During a directional movement of the carriage on the needle bed, a clearing cam mounted alongside the needle bed and extending over the width of the program carrier is engaged with the cam follower lever to pivot same in the particular direction thereby to hold the clearing member in its operative position during over one complete revolution of both drum means to restore all of the settable elements on both drum means to their initial positions. The cam follower lever is so positioned on the carriage that any given settable element on the first drum means is restored to its initial position before it is brought into register with a corresponding needle selection data on the program carrier to be set in accordance therewith during succeeding rotation of the first drum. The arrangement in which data stored on the first drum means, or in other words, settings of the settable elements thereon are thus maintained uncleared until a point of time directly before the first drum means is set in accordance with fresh needle selection data enables the second drum means to be set correctly even if the carriage is reversed directly after all of the settable elements on the first drum means have just been set afresh. On the contrary, if a clearing member for clearing data on the first drum means is alternatively fixed and always operative so that during rotation of the first drum means in one direction any given settable element on the first drum means is cleared after transmission of its data to the corresponding settable element on the second drum means, such reversal of the carriage as described above would lead to a condition in which substantially one half of the total settable elements on the first drum means are operated by the clearing member before they are brought into cooperation with the settable elements on the second drum means thus without transmission of their data to the latter, thereby leading to erroneous needle selection.

DETAILED DESCRIPTION OF THE INVENTION

Figure 1:
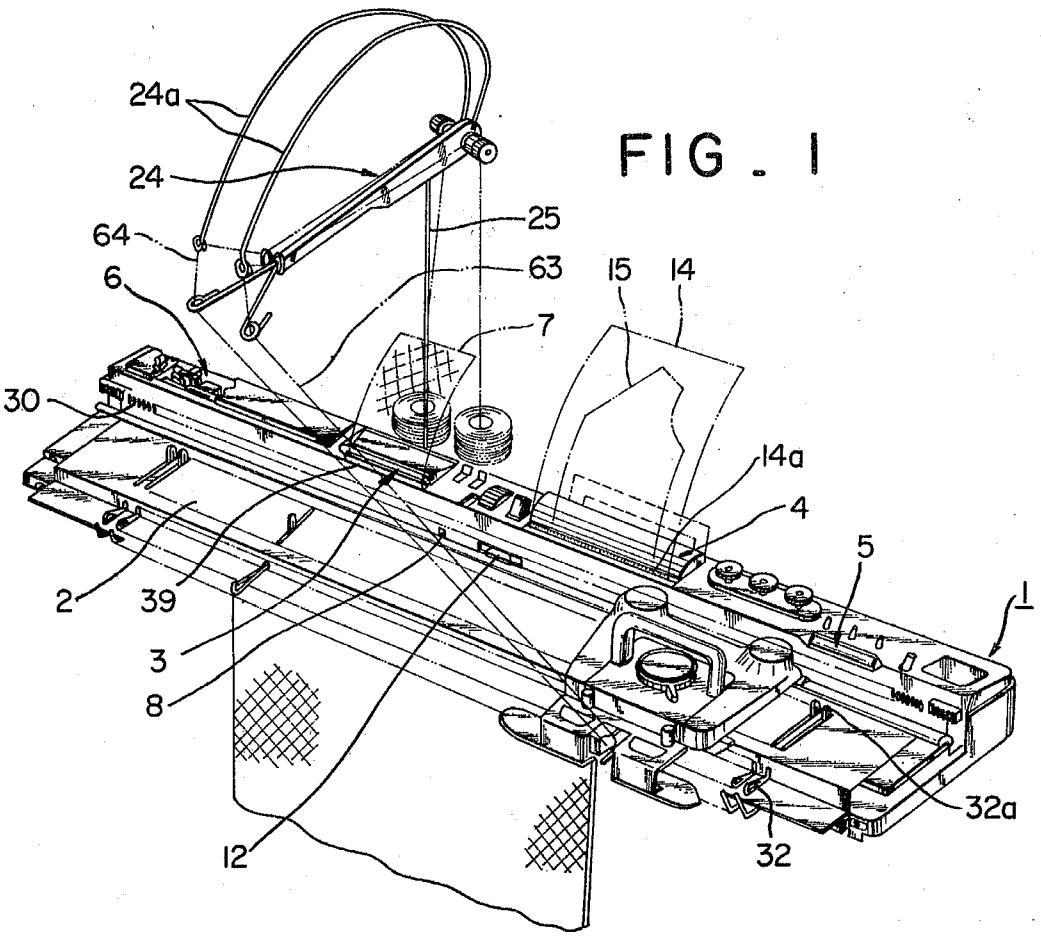
FIG. 1 is a perspective view of a hand-operated knitting machine incorporating a needle selection mechanism according to the present invention.

Referring to FIG. 1, the hand-operated knitting machine consists of a machine body 1 having a needle bed 2 located in the substantial front half section thereof. A plurality of knitting needles 32 each having a butt 32*a* are tricked in the needle bed 2 for individual longitudinal movement therein. A carriage 9 (FIG. 3) is mounted for slidable back and forth movement on the needle bed 2. In the rear half section of the machine body 1, there are disposed, from left to right, a tool receptacle 6 in the form of an elongated tray for receiving therein tools and accessories such as a tappet tool for use with the machine, a program providing device 3 forming part of the needle selection mechanism according to the present invention, a fashioning or knitting width indicator 4 for currently indicating a knitting width, or in other words, the knitting needles 32 to be operated in a current course of knitting, and a row counter 5 for counting the number of rows or courses knitted. Manually operable members such as dials, knobs, push buttons, levers, and the like, for manual control of the program providing device 3, the fashioning indicator 4, and the row counter 5 are also provided suitably on a panel member which covers most part of the rear half section of the machine body 1.

The program providing device 3 has a program carrier 7 removably mounted thereon which is formed as an elongated card or sheet made of paper or a synthetic resin. The program carrier 7 has a pair of rows of perforations 7*a* (FIG. 3) formed along opposite side edges thereof and carries thereon a patterning or needle selection program in the form of punched holes 7*b* (FIG. 4) arranged in rows and columns thereon which program generally indicates a unit design or pattern to be repetitively produced on a knitted fabric. The program carrier 7, when set in position on the program device 3, extends along a path partially surrounding a feed roller 3*a* (FIG. 4) of the program device 3 between a front inlet slit and a rear outlet slit both suitably formed in the panel member on the machine body 1. The program carrier 7 is carried on the feed roller 3*a* with its perforations 7*a* engaged with sprockets of a pair of sprocket wheels provided at opposite ends of the feed roller 3*a* so that upon an incremental angular rotation of the feed roller 3*a* in a clockwise direction in FIG. 4 it is fed from row to row in a proper direction.

Figure 4:
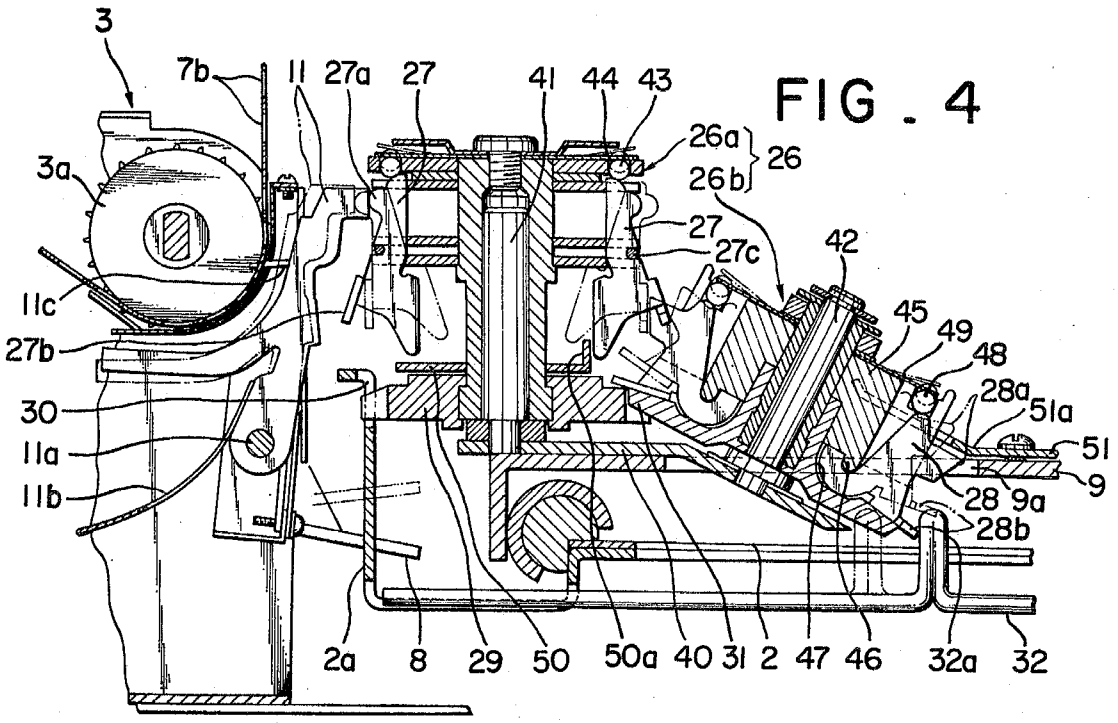
FIG. 4 is an enlarged vertical sectional view of a program providing device and the carriage taken through a plane which contains axes of two drums of the needle selector unit of FIG. 3.
Figure 5:
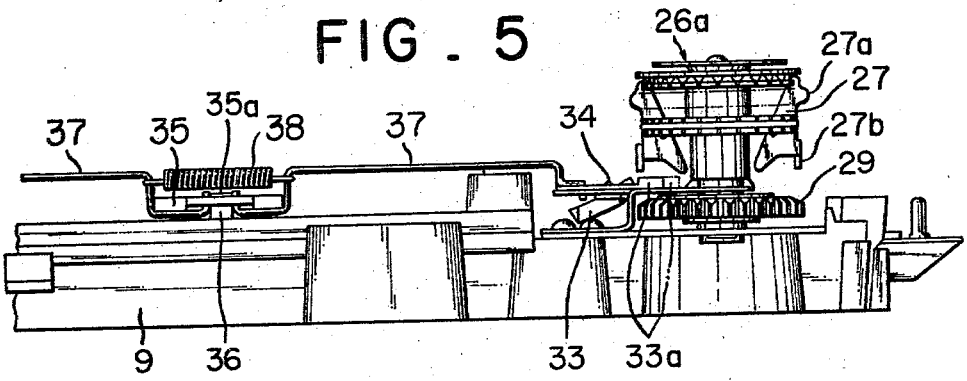
FIG. 5 is a fragmentary rear view of the carriage.

As best seen from FIG. 4, the program device 3 includes a plurality of feeler levers 11 mounted for pivotal motion about a horizontal rod 11*a* which extends in parallel with the needle bed 2. The feeler levers 11 are normally urged clockwise about the rod 11*a* individually by fingers of a spring comb 11*b* to a position shown in full line in FIG. 4. Each feeler lever 11 has a projection or feeler portion 11*c* adapted to sense a punched hole 7*b* in the program carrier 7 when the carriage 9 passes over the program device 3.

The program device 3 further includes a cam follower lever or actuator lever 8 (FIGS. 1, 2 and 4) located near the center of the machine body 1. The actuator lever 8 extends forwardly towards the needle bed 2 through an opening suitably formed in a rear upright wall section 2*a* (FIG. 4) of the needle bed 2. Upon a sliding movement of the carriage 9 on the needle bed, an actuator cam 10 (FIG. 3) mounted on the carriage 9 is engaged with the actuator lever 8 to rock same from a position shown in full line in FIG. 4 to another position shown in phantom line about a pivot pin (not shown) whereby a conventional feed mechanism (not shown) is actuated to angularly rotate the feed roller 3*a* an increment in the clockwise direction to feed the program carrier 7 thereon from row to row in the proper direction.

The fashioning indicator 4 also includes a cam follower lever or actuator lever 12 located adjacent to the actuator lever 8 of the program device 3 and extending towards the needle bed in a similar manner. Upon sliding movement of the carriage 9, an actuator cam 13 (FIG. 3) mounted thereon is engaged with the actuator lever 12 (FIG. 2) to rock same about a vertical pivot pin to actuate an associated feed mechanism (not shown) which thus rotates a feed roller (not shown) to feed a pattern sheet 14 thereon an increment in a predetermined direction.

The pattern sheet 14 consists of an elongated sheet made of paper or a synthetic resin material and carries thereon a pattern 15 representative of a profile of an article to be knitted, such as of a front part of a garment. The pattern sheet 14, when set in position on the fashioning indicator 4, also extends along a path partially surrounding the feed roller between a front inlet slit and a rear outlet slit both suitably formed in the aformentioned panel member. A scale 14*a* having thereon a plurality of appropriate graduations (see FIG. 1) is mounted adjacent to the inlet slit and is adapted to indicate, in cooperation with the pattern 15 on the pattern sheet 14, the knitting width for a current course of knitting or, in other words, the number of knitting needles 32 to be operated in a current knitting operation by the carriage 9.

Figure 2:
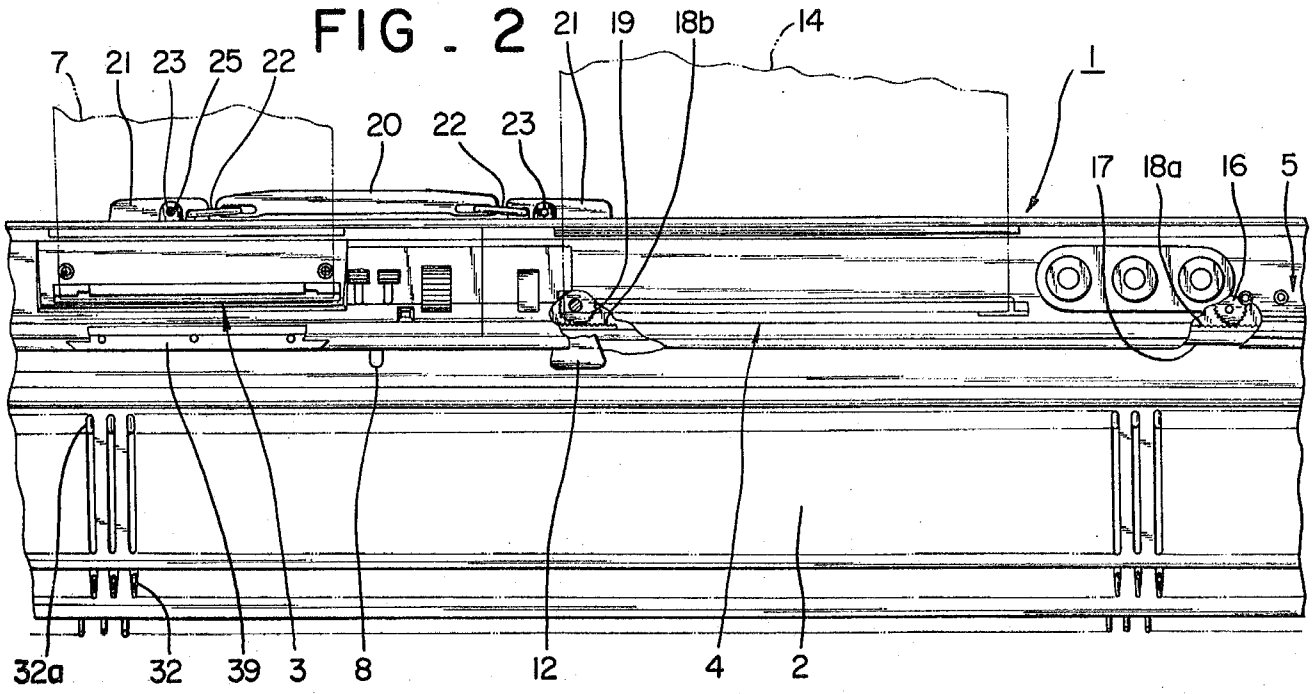
FIG. 2 is a detailed plan view, partly broken, showing part of a body of the knitting machine of FIG. 1.

Referring now to FIG. 2, the aforementioned row counter 5 has a drive mechanism including a pinion 16 which is meshed with a rack 18*a* formed on a connecting rod 17 adjacent one end thereof. Another rack 18*b* formed on the connecting rod 17 adjacent to the other end therof is meshed with another pinion 19 which is mounted on the aforementioned vertical pivot pin for the actuator lever 12 of the fashioning indicator 4. The row counter 5 is thus linked with the actuator lever 12 of the fashioning indicator 4 so that, upon rocking motion of the actuator lever 12, the row counter 5 is operated thereby to increment its counting values in order to digitally indicate the number of knitted rows or courses counted thereon.

The machine body 1 further has a handle 20 provided substantially at the center of the back wall section thereof. The handle 20 has its opposite ends linked to a pair of mounting pieces 21 by means of connecting rings 22. The mounting pieces 21 are each provided with a vertically extending through hole 23 for removably receiving therein the lower end of a support rod 25 (FIG. 1) to support same in an upright position. One of the two holes 23 is located substantially behind the center of the program providing device 3 while the other hole 23 is located behind the left end of the fashioning indicator 4, as best seen from FIG. 2.

The support rod 25 is slightly bent at its middle portion to provide an upright lower portion and in inclined upper portion. A take-up device 24 is supported on the top of the support rod 25. The take-up device 24 has a pair of conventional take-up springs 24*a* adapted to engage with yarns 63, 64 to take up slack thereof intermediately between yarn supplies and the carriage 9. Those yarns 63, 64 are supplied to knitting needles 32 in the needle bed 2 through a yarn feeder mounted on the carriage 9 when the carriage 9 is slidably moved on the needle bed 2.

Since there are provided two mounting pieces 21 as described above, the take-up device 24 can be positioned alternatively above the program providing device 3 or above the fashioning indicator 4. In case the take-up device 24 is positioned above the program device 3, the head and tail ends of the program carrier 7 set on the program device 3 are allowed to bear against the support rod 24 in a reclined position so that the operator of the knitting machine can easily and directly observe the patterning or needle selection data on the exposed front part of the program carrier 7. The front part of the program carrier 7 is thus held in an appropriate position without falling forwardly or hitting upon the carriage 9. As the knitting operation proceeds, the rear end of the program carrier 7 having been discharged from the program device 3 bears against the support rod 25 and uprises therealong. Thus, the program carrier 7 is smoothly discharged under the guidance of the support rod 25.

Figure 3:
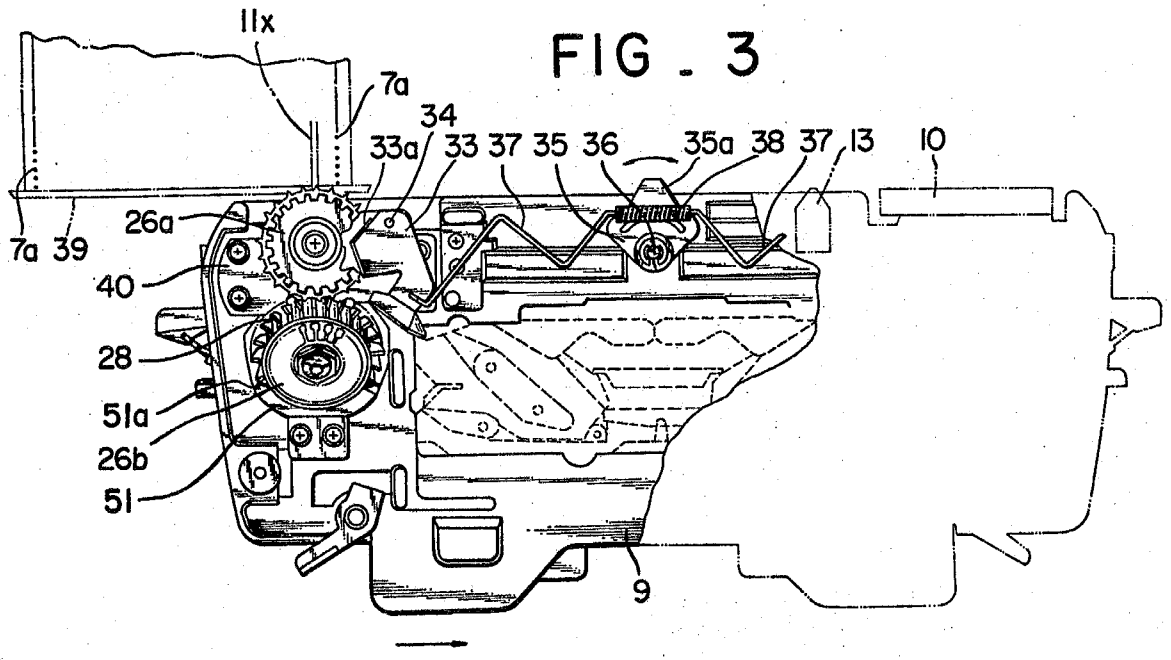
FIG. 3 is a fragmentary plan view of a carriage with its cover removed to show a needle selector unit of the needle selection mechanism.
Figure 6:
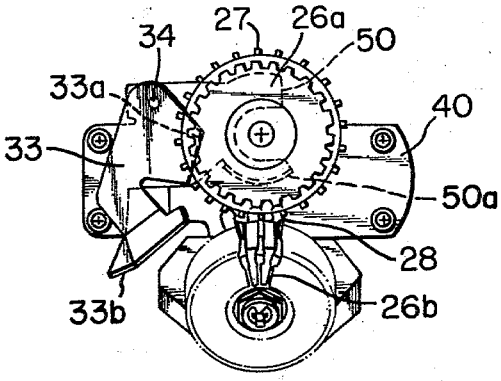
FIG. 6 is a plan view of another needle selector unit to be paired with the unit shown in FIG. 3.

Referring now to FIGS. 3 to 6, the carriage 9 has a generally symmetrical construction relative to the transverse center line thereof, and has a pair of needle selector units 26 mounted adjacent to opposite ends thereof, although there is illustrated only the left-hand side of one of the needle selector units 26 in FIG. 3, the right-hand side needle selector unit 26 being illustrated in FIG. 6 as a separate assembly.

Each needle selector unit 26 includes first and second drums 26*a* and 26*b* each having thereon a predetermined number, typically 24, which is same as the number of the aforementioned feeler levers 11 of the program device 3, of settable elements or tiltable levers 27 and 28, respectively. The tiltable levers 27, 28 are disposed in equidistant circumferential positions on the first and second drums 26*a*, 26*b*, respectively, such that the distance between two adjacent tiltable levers 27 or 28 is equal to that between two adjacent feeler levers 11 of the program device 3 and also to that between two adjacent knitting needles 32 in the needle bed 2.

The tiltable levers 27 on the first drum 26*a* are supported at their mid portions for tilting motion about a support ring 27*c* between a normal position shown in phantom line in FIG. 4 and a tilted position shown in full line in the same figure. Each tiltable lever 27 is provided with an upper projection or input portion 27*a* and a lower bent lug or output portion 27*b*. A detent element 43 in the form of a small steel ball which is urged downwardly by a finger of a leaf spring 44 mounted at the top of the first drum 26*a* acts upon the top end of each tiltable lever 27 to yieldably hold the lever 27 to its normal or tilted position.

The first drum 26*a* is mounted for rotation about an upright shaft 41 and has a gear 29 attached to the lower end thereof and adapted to be meshed with a rack-like element 30 on the rear upright wall section 2*a* of the needle bed 2. The gear 29 is meshed, at a diametrically opposite position to the rack-like element 30, with a second gear attached to the lower end of the second drum 26*b* which is mounted for rotation about an inclined shaft 42. Both shafts 41 and 42 are attached to a support plate 40 mounted on the carriage 9 by means of fastening screws. The support plate 40 is slightly bent at its mid portion so that the front portion thereof extends, together with part of the second drum 26*b*, through an opening 9*a* appropriately formed in the carriage 9 towards the needle bed 2 thereby enabling the tiltable levers 28 on the second drum 26*b* to act upon the butts 32*a* of the needles 32 in the needle bed 2.

Each of the tiltable levers 28 is also provided with an upper projection or input portion 28*a* and a lower bent lug or output portion 28*b*. Each tiltable lever 28 is further provided at the lower end thereof with a curved extension which is received in a spacing formed between an annular rib 46 provided at the bottom end of a body 45 of the second drum 26*b* and the rounded top face 47 of the second gear 31 so that it is allowed to tilt about the annular rib 26*b* between a normal position shown in full line in FIG. 4 and a tilted position shown in phantom line. A detent element 48 in the form of a small steel ball which is urged by a finger of a leaf spring 49 mounted at the top of the second drum 26*b* acts upon the top end of each tiltable lever 28 to yieldably hold the tiltable lever 28 to either of the normal and tilted positions.

When the carriage 9 is slidingly moved in a direction on the needle bed 2, the gear 29 of the first drum 26*a* is rotated in one direction about the shaft 41 by the rack-like element 30 and rolls on and along the element 30 while the second gear 31 is rotated by the first gear 29 in the opposite direction about the inclined shaft 42. While the first drum 26*a* passes over the program device 3 on the machine body 1, the tiltable levers 27 thereon in their normal positions are successively brought into engagement, at the upper projections 27*a* thereof, with the corresponding feeler levers 11 to push them rearwardly against the urging of the leaf spring 11*b* whereupon those of the feeler levers 11 which have a feeler element 11*c* opposed to a punched hole 7*b* of the program carrier 7 are displaced or pivoted rearwardly to the position shown in phantom line in FIG. 4 with the corresponding tiltable levers 27 being allowed to remain in their normal positions whereas those feeler levers 11 which have a feeler element 11c opposed to an unpunched area of the program carrier 7 are blocked by the same to remain in their normal positions thereby to cause the corresponding tiltable levers 27 to be tilted from the normal to the tilted positions. Thus, during one pass of the first drum 26a by the program device 3, the first drum 26a is set in accordance with the data in an appropriate row of punched holes in the program carrier 7, or in other words, the data in a row are stored mechanically on the first drum 26a at the tiltable levers 27 thereon. Also, appropriate row of punched holes in the program carrier 7, or in other words, the data in a row are stored mechanically on the first drum 26a at the tiltable levers 27 thereon. Also, during one complete revolution of the first drum 26a thus set and the second drum 26b, the tiltable levers 28 in their normal position are successively brought into engagement with, at the upper projections 28a thereof, the corresponding tiltable levers 27 at the lower projections 27b thereof to be set thereby in a similar manner. Thus, the data stored on the first drum 27 are transmitted to and stored mechanically on the second drum 28. In order to ensure the transmission of data from the first to the second drum, there is provided means for blocking the tiltable levers 27 of the first drum 26a from being tilted from the tilted back to the normal positions during engagement thereof with the tiltable levers 28 on the second drum 26b to thereby force the tiltable levers 28 to be tilted to the tilted positions. The blocking means consists of a plate member 50 which is fixed on the support plate 40 (FIG. 3) and overlies the gear 29 of the first drum 26a with an appropriate clearance therebetween. The plate member 50 has an upright wall 50a which extends in an arc concentric with the first drum 26a within the range in which the tiltable levers 27 and 28 are engaged with each other. The wall section 50a of the plate member 50 is located just inside the lower ends of the tiltable levers 27 in their tilted position so as to be engaged thereby to retain same in their tilted position.

It is to be noted that each patterning data stored on the first drum 26a is transmitted from a tiltable lever 27 to a corresponding tiltable lever 28 on the second drum 26b after a half revolution of the first drum 26a. Thus, during one complete revolution of the two drums after the first drum 26a begins to sense the patterning data on the program carrier 7 by way of the feeler levers 11 only the first half of the data, that is, the first 12 data in case of the data carrier 7 which typically has up to 24 patterning data in each data row, are transmitted to the second drum 26b. The remaining data, from the 13th to 24th, are transmitted therefore during a subsequent succeeding half revolution of the drums 26a, 26b. Accordingly, the transmission of all the data from the first to the second drum requires one and a half revolutions of the drums 26a, 26b.

The selector assembly further includes a clearing member 33 which has two cam means or faces 33a and 33b (FIG. 6) provided thereon. The clearing member 33 is supported on a pin 34 for pivotal motion between an operative position (indicated in phantom in FIG. 5) in which the cam faces 33a and 33b are engaged with the tiltable levers 27 and 28 on the first and second drums 26a and 26b, respectively, to restore them to their normal positions thereby to clear the data stored on them and an inoperative position (indicated in full line in FIGS. 3 and 5) inoperative to the drums 26a and 26b.

A cam follower lever 35 is pivotally mounted on a pin 26 fixed at a rear center position of the carriage 9 and has its opposite sides linked to the two clearing members 33 through connecting rods 37. Each connecting rod 37 has one end projected into an arcuate slot formed in the cam follower lever 35 to provide a lost motion connected between the lever 35 and the clearing member 33. The cam follower lever 35 is normally retained in a neutral position by a coil spring 38 which is tensioned between the two connecting rods 37, with its engaging portion 35a projected rearwardly of the carriage 9, to hold the clearing members 33 in their inoperative position.

A clearing cam 39 is fixed beneath the front side of the program device 3 over a distance substantially the same as or rather greater than the length of the array of the feeler levers 11 of the program device 3. Thus, upon a sliding movement of the carriage 9, the clearing cam is engaged by the engaging portion 35a of the cam follower lever 35 to pivot the lever 35 in a clockwise or counterclockwise direction (FIG. 3) against the force of the tension spring 38.

When the cam follower lever 35 is pivoted clockwise during a leftward movement of the carriage 9, only the right one of the connecting rods 37 (FIG. 3) is operated due to the lost motion connection to displace the right-hand clearing member 33 into its operative position. On the other hand, the left-hand connecting rod 37 is operated by counterclockwise rotation of the cam follower lever 35 to displace the left-hand member 33 into its operative position. As the carriage 9 is slid back and forth, the needle selecting operation is performed by that one of the selector units 26 which precedes in reference to the direction of the sliding movement of the carriage 9. Before the other succeeding selector unit 26 reaches the program device 3, the cam follower lever 35 which is located centrally between the two selector units 26 is engaged with the operating cam 39 to pivot in a direction whereby the clearing member 33 of the succeeding selector unit 26 is displaced into its operative position to clear the patterning data stored on both drums 26a and 26b for the preceding course of knitting. After such clearing of the patterning data, fresh patterning data for a next subsequent course of knitting are sensed and transmitted to the succeeding selector unit 26 and stored thereon.

It is to be noted here that the program carrier 7 on the program device 3 is fed from row to row at a suitable point of time during a directional movement of the carriage 9 after the preceding selector unit 26 has left the program device 3 and before the succeeding selector unit 26 is brought into before the succeeding selector unit 26 is brought into cooperation with the program device 3. The actuator lever 8 and the actuator cam 10 are so positioned relative to each other on the machine body 1 and the carriage 9, respectively, to allow the program carrier 7 to be fed at such point of time.

Now, transmission of patterning data is investigated rather more in detail. Let us assume that the program carrier 7 includes up to 24 patterning data in each data row thereof and the carriage 9 has been moved from the left across the program device 3 to the position as shown in FIG. 3 in which the last feeler lever, that is, the 24th feeler lever 11x is engaged with a corresponding tiltable lever 27 on the first drum 26a with data transmitted to the lever 27 therefrom. In the position of the carriage 9, the 24 patterning data have been transmitted to be stored on the first drum 26*a* while the first half of the data, that is, the 1st to 12th data have been transmitted to the 1st to 12th tiltable levers 28 of the second drum 26*b* which are positioned on the right-hand half of the second drum 26*b* since the first and second drums 26*a* and 26*b* are rotated counterclockwise and clockwise, respectively, about their axes. The remaining 13th to 24th patterning data which are on the left-hand half of the first drum 26*a* are not yet transmitted to the second drum 26*b*. It will be readily understood that a further rightward movement of the carriage 9 which causes a half revolution of the drums 26*a* and 26*b* causes the remaining patterning data to be transmitted to be stored on the second drum 26*b*, which thus has all the patterning data stored thereon. On the contrary, if the carriage 9 is now moved reversely to the left from the position as shown in FIG. 3, the first and second drums 26*a* and 26*b* are rotated clockwise and counterclockwise, respectively, and the remaining 13th to 24th patterning data stored on the first drum 26*a* will be transmitted one after another to the second drum 26*b* in the latter half of a subsequent one complete revolution of either drum 26*a*, 26*b* in the above-identified direction. During such one revolution of the drums 26*a*, 26*b*, the feeler levers 11 are again engaged by the tiltable levers 27 on the first drum 26*a* and sense to transmit the same patterning data to the first drum 26*a*; the program carrier 7 is fed from row to row during a further leftward movement of the carriage 9. The manner of data transmission in the right-hand selector unit 26 is similar to that as described above with an exception that the arrangement is symetrically relative to the transverse center line of the carriage 9 as described before.

Figure 7:
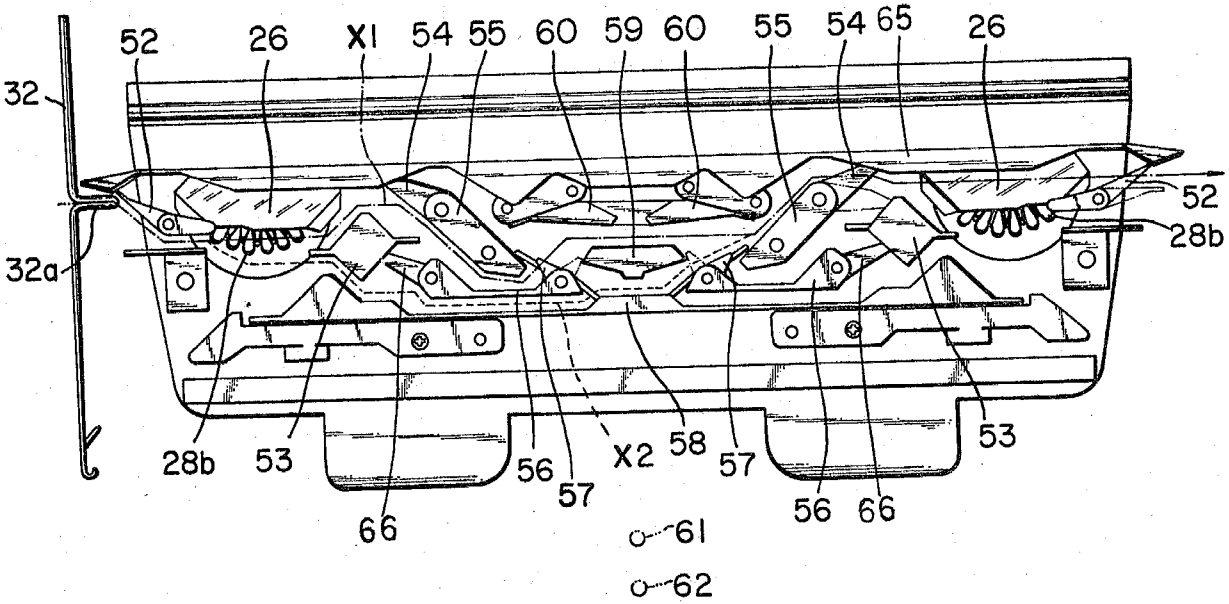
FIG. 7 is a bottom view of the carriage showing the cam arrangement thereon.

While patterning data are stored afresh on the preceding one of the selector units 26 during each directional movement of the carriage 9 as described above, needle selection is effected by the succeeding one of the selector units 26. FIG. 7 shows a preferred cam arrangement which is suitably adapted for such needle selection system. The cam arrangement also has a generally symmetrical construction relative to the transverse center line of the carriage 9 and includes a front partition wall 58 located in a frontmost position and extending along most of the length of the carriage 9. A fixed center cam 59 is located behind the partition wall 58 at the center of the carriage 9. A pair of second partition walls 56 are located also behind the front partition wall 58 at opposite side of the center cam 59. A knitting cam 55 having an auxiliary cam 54 pivotally mounted thereon is located behind each second partition wall 56. A fixed substantially rectangular cam 53 disposed to provide cam edges askew to the length of the carriage 9 is located outside the second partition wall 56 and the knitting cam 55. The needle selector member, that is, part of the second drum 26*b* is disposed adjacent and outside the rectangular cam 53. At an outermost position adjacent to either end of the carriage 9 and to either needle selector member 26, a pivotal cam 52 is mounted for pivotal motion about a pivot and is normally urged to engage with an outer extension of a rear partition wall 65 by a torsion spring (not shown). In order to attain a variety of butt paths for knitting various kinds of stitches such as a plain stitch, a tuck stitch, a welt stitch, a fair-isle stitch, a punch lace stitch, and so on, some of the cams and some other cams such as the auxiliary cams 55, knit-in or tuck cams 60, and change-over cams 66, are manually adjustable to preselected positions by means of a known control means including a manually operable member, such as a cam lever, description of which is omitted.

Two typical butt paths X1 and X2 are shown in FIG. 7 which are adapted for a punch lace stitch. Upon movement of the carriage 9 on the needle bed 2, butts 32*a* of the knitting needles 32 are first guided by a pivotal cam 52 and then selectively separated into two groups by a needle selector member 26. The needle butts 32*a* in a first group not selected will therefore follow the first butt path X1 while the needle butts in a second group selected will follow the second butt path X2. The first needles 32 are first lowered a little and then raised by the knitting cam 55 beyond the clearing position whereafter they are lowered to an intermediate position at which they are supplied with two yarns such as a yarn 63 and a nylon thread 64 (FIG. 1) fed through first and second eyes 61 and 62 (FIG. 7), respectively, both formed on a yarn feeder mounted on the carriage 9. The first needles 32 are then further lowered by the other knitting cam 55 beyond the knockover position to knit the two yarns 63 and 64 into needle loops. The second needles 32 are first raised beyond the clearing positions further than the first needle 32 and then lowered by the front partition wall 58, the second partition wall 56 and a swing cam 57 mounted pivotally thereon and are supplied with a yarn such as the nylon thread 65 fed through the front eye 62. The first needles 32 are then further lowered by the knitting cam 55 beyond the knock-over position to knit the yarn 57 into needle loops whereafter they are disengaged from the carriage 9 together with the first needles 32. Thus, a row of punch lace stitches can be knitted by a directional movement of the carriage 9 on the needle bed 2.

As seen from FIG. 7, needle butts 32*a* in the second group follow an arcuate path relative to the carriage 9 which is substantially concentric with the second drum 26*b* when they are engaged to be displaced by the tiltable levers 28 for their selection. The arcuate path appears due to the fact that the needle butts 32*a* are pushed forwardly by the lower bent lugs 28*b* of the tiltable levers 28 of the second drum 26*b*. In particular, the bent lugs 28*b* have a semicircular configuration at its outer half section, as seen from FIG. 7. During rotation of the drum 26*b*, a tiltable lever 28 in its normal position is engaged, at an outer semicircular portion of its lower bent lug 28*b*, with a butt 32 of a knitting needle which is in a longitudinal position as shown in phantom in FIG. 4, and gradually pushed it forwardly to a position in full line in FIG. 4 as the center of the arc of the lower bent lug 28*b* are substantially held aligned with the needle butt 32*a*. Thus, the needle butt 32*a* actually moves along a portion of the arc of the bent lug 28*b* relative to each other while it is pushed forwardly. A tiltable lever 28 on the second drum 26*a* which is in its tilted position as shown in phantom in FIG. 4 has its lower bent lug 28*b* positioned above a needle butt 32*a* in its phantom position so that it is not engaged with the needle butt 32*a* which is thereafter allowed to enter between two adjacent teeth of the gear 31 of the second drum 26*b*. The second drum 26*b* has an alternate arrangement of the teeth of the gear 31 and the lower bent lugs 28*b* of the tiltable levers 28, as seen from FIG. 7. Thus, the knitting needles 32 having butts 32*a* not engaged by the tiltable levers 28 of the second drum 26*a* are allowed to remain in their position until they are subsequently lowered by a following cam 53.

ew. The plate member 51 has which extend to surround an upper the second drum 26b with a suitable clear- therebetween. Pivotal motion of a tiltable lever 28 from its normal to tilted position is prevented by en- gagement of its upper projection 28a with the plate member 51. Reverse pivotal motion is also prevented by the plate member 51.

While the present invention has been described in onnection with the preferred embodiment, it is appar- t to those skilled in the art that various changes and difications can be made without departing from the it and scope of the invention as defined in the ap- ed claims and their legal equivalent.

at is claimed is:

Needle selection mechanism in a hand-operated machine of the type having a needle bed with a of knitting needles mounted therein and a car- unted for longitudinal slidable movement of bed, the mechanism comprising a program nted alongside the needle bed and carri program in the form of pun ows and columns there rising a first dr ttable gagement udes an arcuate ited on the carriage 9 rum means being restored to their initial positions by a clearing means mounted on the carriage after comple- tion of selection of the knitting needles in accordance with the settings on the second drum means, and the clearing means including a common clearing member which is mounted for pivotal motion from an initial inoperative position to an operative position in which it is engaged with the settable elements of the first and the second drum means in their set positions to restore same to their initial positions.

2. The needle selection mechanism as claimed in claim 1 wherein the clearing means further includes a clearing cam mounted alongside the needle bed and extending over the range of the program carrier along the length of the needle bed, a cam follower pivotally mounted on the carriage for engagement with the clear- ing cam and operatively connected with the clearing member, and a spring for urging the cam follower initial position and the clearing member tive position, the cam follower bei carriage is moved in the oth ing cam to be piv member is m settabl